US008216383B2

(12) United States Patent
Yang et al.

(10) Patent No.: US 8,216,383 B2
(45) Date of Patent: Jul. 10, 2012

(54) METHODS AND COMPOSITION FOR CLEANING A HEAT TRANSFER SYSTEM HAVING AN ALUMINUM COMPONENT

(75) Inventors: Bo Yang, Ridgefield, CT (US); Aleksei V. Gershun, Southbury, CT (US); Peter M. Woyciesjes, Woodbury, CT (US)

(73) Assignee: Prestone Products Corporation (NZ)

( * ) Notice: Subject to any disclaimer, the term of this patent is extended or adjusted under 35 U.S.C. 154(b) by 0 days.

(21) Appl. No.: 12/830,854

(22) Filed: Jul. 6, 2010

(65) Prior Publication Data

US 2011/0000505 A1 Jan. 6, 2011

Related U.S. Application Data

(60) Provisional application No. 61/223,272, filed on Jul. 6, 2009.

(51) Int. Cl.
*C23G 1/02* (2006.01)

(52) U.S. Cl. ..... 134/2; 134/3; 134/22.1; 134/22.14; 134/22.19; 134/26; 134/28; 134/30; 134/34; 134/36; 134/41; 134/42; 510/469; 510/477; 510/488; 510/500; 510/512

(58) Field of Classification Search ..... 134/2, 3, 134/22.1, 22.14, 22.19, 226, 28, 30, 34, 36, 134/41, 42; 510/469, 477, 488, 500, 510, 510/512

See application file for complete search history.

(56) References Cited

U.S. PATENT DOCUMENTS

| | | | | |
|---|---|---|---|---|
| 3,962,109 | A * | 6/1976 | Oberhofer et al. | 252/75 |
| 4,218,354 | A * | 8/1980 | Hayati et al. | 106/287.13 |
| 5,338,477 | A | 8/1994 | Chen et al. | |
| 2003/0218150 | A1 * | 11/2003 | Blakemore et al. | 252/73 |
| 2004/0038840 | A1 | 2/2004 | Lee et al. | |
| 2005/0023505 | A1 * | 2/2005 | Blakemore et al. | 252/176 |
| 2007/0075120 | A1 | 4/2007 | Yang et al. | |
| 2009/0065735 | A1 * | 3/2009 | Kolics et al. | 252/79.1 |
| 2009/0215265 | A1 | 8/2009 | Thomas et al. | |
| 2009/0294725 | A1 * | 12/2009 | Sundaram et al. | 252/175 |
| 2010/0116473 | A1 | 5/2010 | Yang et al. | |
| 2010/0116870 | A1 | 5/2010 | Morii | |
| 2010/0261632 | A1 * | 10/2010 | Korzenski et al. | 510/175 |
| 2011/0000505 | A1 * | 1/2011 | Yang et al. | 134/2 |

FOREIGN PATENT DOCUMENTS

WO 03083582 A1 10/2003

OTHER PUBLICATIONS

International Search Report; International Application No. PCT/US2010/041059: International Filing Date: Jul. 6, 2010; Date of Mailing: Feb. 21, 2011; 5 Pages.

Written Opinion of the International Searching Authority; International Application No. PCT/US2010/041059; International Filing Date: Jul. 6, 2010; Date of Mailing: Feb. 21, 2011; 3 Pages.

* cited by examiner

*Primary Examiner* — Bibi Carrillo

(74) *Attorney, Agent, or Firm* — Barnes & Thornburg LLP

(57) ABSTRACT

Disclosed herein is a method and treatment system for rapid cleaning and protecting of automotive cooling systems containing controlled atmosphere brazed aluminum heat exchangers. The method and treatment system can optionally include a conditioning (passivating) step. The treatment system can comprise three different parts: (1) cleaner or cleaning solution; (2) conditioner or conditioning solution; and (3) compatible CAB aluminum protective heat transfer fluid.

13 Claims, 2 Drawing Sheets

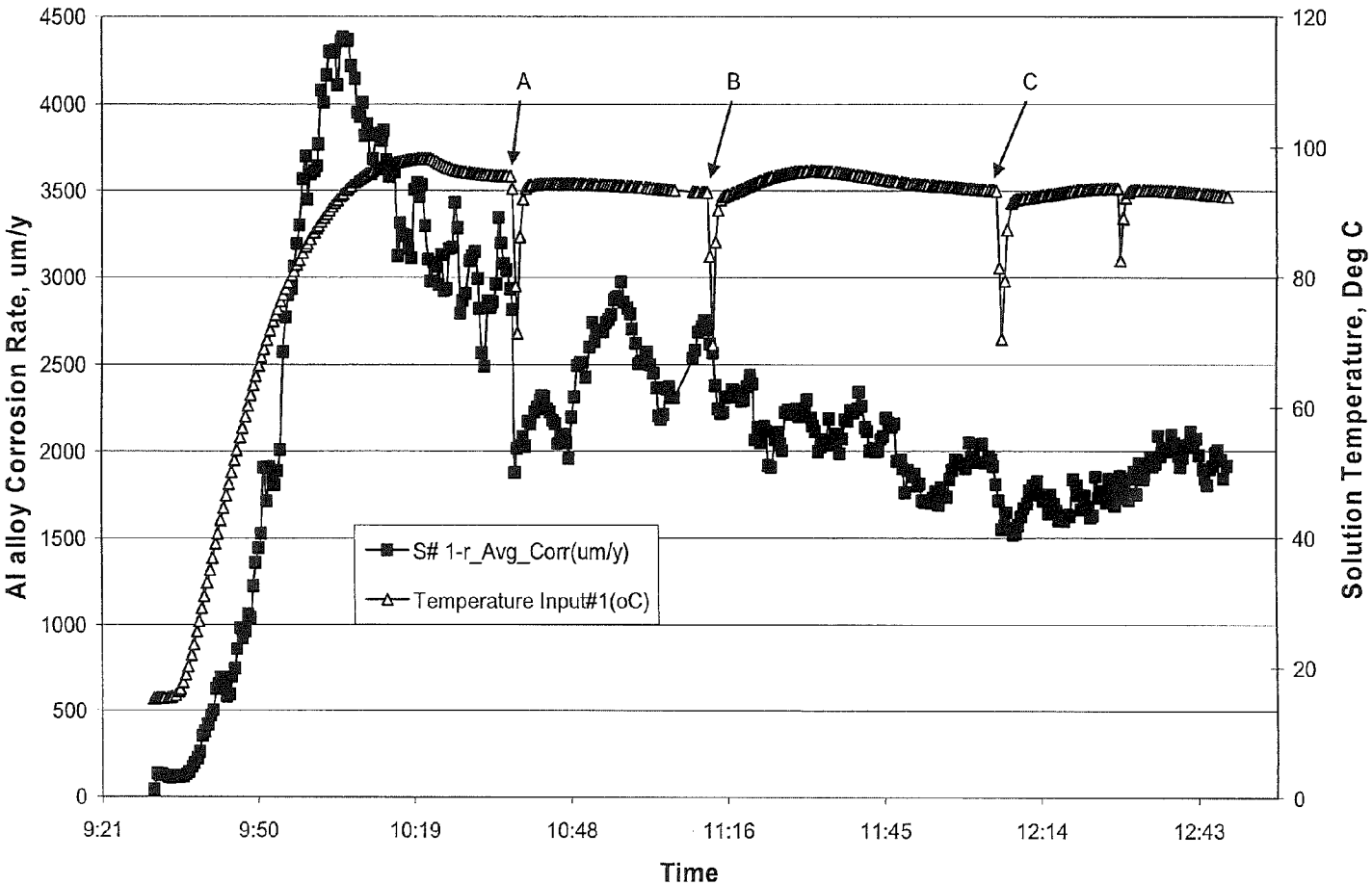
Figure 1. nanoCorr - Corrosion of an aluminum alloy in 2.0 wt% Oxalic acid dihydrate aqueous solution as a function of time, temperature and additive additions. A&B: Slug dose 1000mg/L benzotriazole @ 10:40 and 11:13; C: Slug dose 2000mg/L benzotriazole

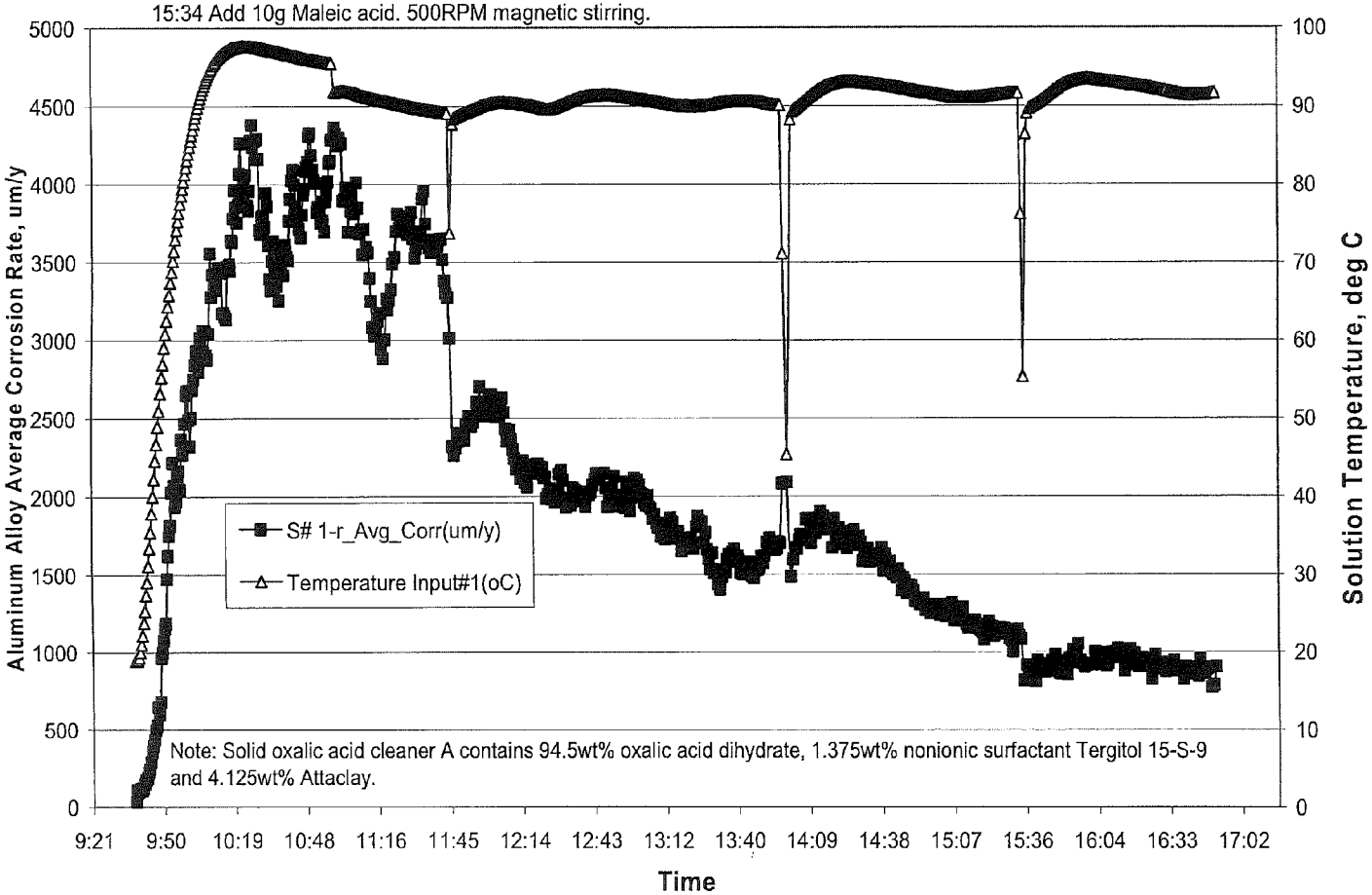
Figure 2. Corrosion of an Aluminum Alloy in 2.1wt% Solid Oxalic Acid Cleaner A (2wt% oxalic acid dihydrate) vs. time, temperature, and effect of BZT, MBT and Maleic acid addition
500 g solution (587.4g de-ionized water + 12.6g Oxalic acid dihydrate based solid cleaner A) used in the test
9:38 Test Start; 11:45 Add 3.75g Benzotriazole; 14:00 Add 0.25g Mercaptobenzothioazole;
15:34 Add 10g Maleic acid. 500RPM magnetic stirring.

METHODS AND COMPOSITION FOR CLEANING A HEAT TRANSFER SYSTEM HAVING AN ALUMINUM COMPONENT

CROSS REFERENCE TO RELATED APPLICATIONS

This application claims the benefit of U.S. Provisional Application No. 61/223,272 filed on Jul. 6, 2009 and which is incorporated by reference herein in its entirety.

BACKGROUND

Automotive heat exchangers, such as radiators, heater cores, evaporators and condensers are predominantly made of aluminum alloys to reduce the weight of the vehicles. These heat exchangers can be the tube and fin type where the fins are corrugated and/slotted at right angles to the direction of air flow.

In the past, mechanical expansion techniques have been used for mass-production of automotive finned-tube heat exchangers. Heat exchangers are now predominantly formed by a brazing operation, wherein the individual components are permanently joined together with a brazing alloy.

Since the early 1980s, one brazing technique known as controlled atmosphere brazing (CAB) has become increasingly popular for use by automotive industry to make brazing aluminum heat exchangers. CAB has been preferred over a previous brazing method, i.e., vacuum furnace brazing, due to improved production yields, lower furnace maintenance requirements, greater braze process robustness, and lower capital cost of the equipment employed.

When manufacturing the heat exchangers using the CAB process, an aluminum brazing filler alloy (e.g., AA 4345 or AA 4043) is often pre-cladded or coated on at least one side of the core aluminum alloy sheet (or brazing sheet). Alternatively, a prebraze arc sprayed Zn coating is applied on the non-clad tubes (e.g., via a wire arc spraying process) to improve their corrosion resistance. The aluminum core alloys of the fins and tubes are typically AA 3003 or various "long life alloys" or modified AA 3003 alloys with additions of small amounts of elements typically selecting from Cu, Mg, Mn, Ti, Zn, Cu, Cr and Zr.

In the CAB process, a fluxing agent is applied to the pre-assembled component surfaces to be jointed. During brazing at approximately 560 to 575° C., the fluxing agent starts to melt and the melted flux reacts, dissolves and displaces the aluminum oxide layer that naturally formed on the aluminum alloy surface and frees up the brazing filler alloy. The brazing filler alloy starts to melt at about 575-590° C. and begins to flow toward the joints to be brazed. During the cooling process, the filler metal solidifies and forms braze joints. The flux present on the surface also solidifies and remains on the surface as flux residue.

Additional functions of the fluxing agent are to prevent reformation of an aluminum oxide layer during brazing, enhance the flow of the brazing filler alloy, and increase base metal wettability. The fluxing agent is typically a mixture of alkaline metal fluoroaluminates with general formula $K_{1-3}AlF_{4-6}.xH_2O$, which is essentially a mixture of $K_3AlF_6$, $K_2AlF_5$ and $KAlF_4$. Fluoride-based fluxes are preferred over chloride based fluxes for brazing aluminum or aluminum alloys because they are considered to be inert or non-corrosive to aluminum and its alloys, and substantially water insoluble after brazing. When the recommended flux coating weight (3-5 gram per square meter ($g/m^2$) for furnace brazing) is used, the CAB process is said to generate a 1-2 micrometers (μm) thick tightly adherent non-corrosive residue. Hence, it is believed that no removal of the flux residue is necessary after the brazing operation.

Due to the reported non-corrosive nature of the flux, its tolerance to brazing assembly fit-up and flexible control, CAB is one of the lowest cost methods for the joining of aluminum heat exchangers. It is now commonly used by the automotive and other industries for manufacturing of heat exchangers.

BRIEF SUMMARY

Recent studies conducted by us show that residues from potassium fluoroaluminate fluxes are soluble in commercial heat transfer fluids and will leach out fluoride and aluminum ions. These ions can enhance the corrosion of metals in the engine cooling system and/or degrade the heat transfer fluid corrosion protection and the heat transfer performance of the system. The amount of fluoride and aluminum ions that release into the heat transfer fluid depends on the chemical composition of the heat transfer fluid, the amount of flux loading, composition of the flux used, other variables involved in the brazing process, exposure time, as well as the operating conditions and design attributes of the cooling system. The extent of corrosion and degradation of heat transfer performance of the cooling system tend to increase with increasing exposure time.

The ion leaching and subsequent corrosion problems affect both new and used vehicles. In vehicles having a CAB aluminum component recently installed or about to be installed it is desirable to prevent leaching and corrosion. In a used vehicle where the leaching and corrosion has already occurred it is desirable to remove the corrosion products and protect against further corrosion. The presence of corrosion products can diminish heat transfer performance.

Thus, there is a need for compositions and methods to clean and remove the corrosion products or prevent their formation, to maintain or restore heat transfer fluid flow and heat transfer performance, to prevent corrosion damage or prevent or minimize additional corrosion damage and maintain heat transfer performance during the operation and lifetime of the vehicle cooling system containing controlled atmosphere brazed aluminum components.

The aforementioned need is addressed by a method and a treatment system for rapid cleaning and protecting of automotive cooling systems containing controlled atmosphere brazed aluminum heat exchangers. The method and treatment system can optionally include a conditioning (passivating) step. The treatment system can comprise three different parts: (1) cleaner or cleaning solution; (2) conditioner or conditioning solution; and (3) compatible CAB aluminum protective heat transfer fluid. It is explicitly contemplated that these three components can be used in combination or can be used independently.

The method and treatment system are described in greater detail below.

BRIEF DESCRIPTION OF THE DRAWINGS

FIGS. 1-2 show the data generated in Example 7.

DETAILED DESCRIPTION

It has been discovered that aluminum components made by CAB can be cleaned prior to coming in contact with a heat transfer fluid in a heat transfer system so as to reduce undesirable ion leaching from the flux and subsequent corrosion.

Corrosion products may reduce heat transfer efficiency. In order to improve heat transfer fluid life, it is also desirable to passivate the heat transfer system prior to adding new heat transfer fluid and/or after cleaning and installing new parts in the heat transfer system. Passivation creates a protective film on the surfaces of the components of the heat transfer system which protects the components against corrosion.

A method and composition for removing corrosion products from a heat transfer system comprising a CAB aluminum component is also disclosed herein. In order to improve heat transfer fluid life, it is also desirable to passivate the heat transfer system prior to adding new heat transfer fluid after cleaning the heat transfer system.

The cleaner comprises an organic acid having a pKa of less than or equal to 5.0 at 25° C., and an azole compound. The organic acid can have a pKa of less than or equal to 4.5, or, more specifically, less than or equal to 4.0, or, more specifically, less than or equal to 3.5, or, more specifically less than or equal to 3.0, or, more specifically, less than or equal to 2.5, or, more specifically less than or equal to 2.0, all at 25° C. The organic acid can be an aliphatic or aromatic organic acid. In addition to containing carbon, hydrogen and oxygen atoms, the organic acid molecule can also contain from 0 to 4 sulfur atoms, 0 to 4 nitrogen atoms and/or 0 to 4 phosphorous atoms. The organic acid can comprise one or more carboxylic acid groups. One consideration in choosing an organic acid is the solubility in an aqueous system as the cleaner is combined with water to form an aqueous cleaning solution. Hence the organic acid has to have sufficient solubility in the aqueous cleaning solution to be present in an amount in the cleaning solution such that cleaning can be completed in a timely manner—typically on a time scale of minutes or hours and usually less than 24 hours.

An additional consideration in choosing an organic acid is the efficiency of cleaning and the potential for corrosion. In some embodiments it is desirable to select an organic acid which results in cleaning in a short period of time (high efficiency). However, the efficiency of cleaning must be balanced with a low potential for causing corrosion.

Organic acids include taurine or 2-aminoethanesulfonic acid, cysteic acid, dihydroxytartaric acid, aspartic acid, 1,1-cyclopropanedicarboxylic acid, picric acid, picolinic acid, aconitic acid, carboxyglutamic acid, dihydroxmalic acid, 2,4,6-trihydroxybenzoic acid, 8-quinolinecarboxylic acid, oxalic acid, maleic acid, and combinations of two or more of the foregoing acids. Also included are the anhydride equivalents of the foregoing organic acids. It is contemplated that combinations of organic acids and organic anhydrides can be used. The most preferred organic acid for use in the cleaner is oxalic acid. Oxalic acid and maleic acid (or maleic anhydride) mixture may also be used in the cleaner.

The cleaner can comprise a combination of organic acids having a pKa of less than or equal to 5.0 at 25° C. The combination of organic acids can have a pKa of less than or equal to 4.5, or, more specifically, less than or equal to 4.0, or, more specifically, less than or equal to 3.5, or, more specifically less than or equal to 3.0, or, more specifically, less than or equal to 2.5, or, more specifically less than or equal to 2.0, all at 25° C.

The cleaner can comprise the organic acid(s) in an amount of 0.1 to 99 weight percent based on the total weight of the cleaner. Within this range the cleaner can comprise the organic acid(s) in an amount of 0.5 to 97 weight percent, or, more specifically 1 to 95 weight percent, or, more specifically, 2 to 90 weight percent based on the total weight of the cleaner.

The cleaner can comprise a single azole compound or a combination of azole compounds. Azole compounds comprise a 5- or 6-member heterocyclic ring as a functional group, wherein the heterocyclic ring contains at least one nitrogen atom. Exemplary azole compounds include benzotriazole (BZT), tolyltriazole, methyl benzotriazole (e.g., 4-methyl benzotriazole and 5-methyl benzotriazole), butyl benzotriazole, and other alkyl benzotriazoles (e.g., the alkyl group contains from 2 to 20 carbon atoms), mercaptobenzothiazole, thiazole and other substituted thiazoles, imidazole, benzimidazole, and other substituted imidazoles, indazole and substituted indazoles, tetrazole and substituted tetrazoles, and mixtures thereof.

The cleaner can comprise the azole compound(s) in an amount of 0.001 to 10 weight percent based on the total weight of the cleaner. Within this range the cleaner can comprise the azole compound(s) in an amount of 0.01 to 7 weight percent, or, more specifically, 0.02 to 6 weight percent, or, more specifically, 0.05 to 5 weight percent.

The cleaner can further comprise a glycol such as ethylene glycol, propylene glycol or combination thereof.

The cleaner can comprise the glycol in an amount of 0 to about 15 weight percent based on the total weight of the cleaner.

The cleaner can further comprise water as a solvent. Water can also be present in the cleaner due to the use of a raw material containing water, in either crystalline or non-crystalline form.

The cleaner can further comprise an organic phosphate ester such as Maxhib AA-0223, Maxhib PT-10T, or combination thereof.

The cleaner can comprise the organic phosphate ester in an amount of 0 to about 10 weight percent based on the total weight of the cleaner.

The cleaner can further comprise an additional corrosion inhibitor. Exemplary additional corrosion inhibitors include acetylenic alcohols. amides, aldehydes, imidazolines, soluble iodide compounds, pyridines, and amines.

The cleaner can comprise an additional corrosion inhibitor in an amount of 0 to 10 weight percent based on the total weight of the cleaner.

The cleaner can further comprise an acrylic acid or maleic acid based polymer such as a polyacrylic acid, a polymaleic acid, or combination thereof. Also included are acrylic acid and maleic acid copolymers and terpolymers including those having sulfonate groups. Exemplary materials include Acumer 2000 and Acumer 3100.

The cleaner can further comprise a surfactant such as an ethylene oxide polymer or copolymer, a propylene oxide polymer or copolymer, a $C_8$-$C_{20}$ ethoxylated alcohol or combination thereof. Exemplary surfactants include Pluronic L-61, PM 5150, Tergitol 15-2-9 (CAS #24938-91-8), Tergitol 24-L-60 (CAS #68439-50-9) and Neodol 25-9 (CAS #68002-97-1).

The cleaner can further comprise a colorant such as a non-ionic colorant. Exemplary non-ionic colorants are available under the Liquitint© brand name from Milliken Chemicals.

The cleaner can further comprise one or more of the following: scale inhibitors, antifoams, biocides, polymer dispersants, and antileak agents such as attaclay and soybean meals.

The cleaner may be in solid or liquid form.

The cleaner is combined with water to form a cleaning solution. The water maybe deionized or clean tap water. The cleaning solution may be provided to the end user or the cleaner may be provided to the end user with instructions for the preparation of the cleaning solution. It is also contemplated that the cleaner may be a liquid concentrate which is further diluted by the end user with water.

An exemplary cleaning solution composition comprises water, 0.1 to 99 weight percent (wt %) of oxalic acid, 0.001 to 4 wt % of an azole compound, 0 to 10 volume percent of ethylene glycol, 0 to 20 wt % of maleic acid or maleic anhydride, 0 to 20 wt % of an organic phosphate ester, 0 to 20 wt % of an organic acid having a pKa less than 5.0 at 25° C. (other than the oxalic acid and maleic acid), and 0 to 5 wt % of an acrylic acid or maleic acid based polymer.

The cleaning solution can have a pH less than or equal to 5.0, or more specifically less than or equal to 4.5, or, more specifically, less than or equal to 3.5, or, more specifically, less than or equal to 2.5, or, more specifically, less than or equal to 2.0, or, more specifically, less than or equal to 1.8, or, more specifically, less than or equal to 1.5. The pH of the cleaning solution is determined at room temperature (20-25° C.).

Typically any heat transfer fluid present in the heat transfer system is drained prior to cleaning. The heat transfer system can be flushed with water prior to adding the cleaning solution to the heat transfer system and drained. Some heat transfer systems are difficult to drain and retain a significant amount of the previously circulated fluid. The heat transfer system is filled with the cleaning solution. The engine is started and run for a period of time which can be for a few minutes to several hours. The cleaning solution can be recirculated. The cleaning solution can be recirculated by an internal pump (i.e., the water pump in a vehicle engine) and/or one or more external pumps in the cooling system to be cleaned. Alternatively, the cleaning solution can be gravity fed into the system. Additionally, a filter, such as a bag filter, can be used during the recirculation of the cleaning solution. The filter can be installed in a side stream of the recirculation loop or in a location of the system so that it can be removed or exchange easily during the cleaning process without interruption of the circulation of the cleaning solution in the main part of the system. The filter can have openings or pore size of 10 microns to 200 microns. After the cleaning is completed, the engine is shut off and the cleaning solution is drained from the system and the system is flushed with water.

An exemplary cleaning procedure utilizes an external pump and a fluid reservoir open to atmospheric pressure. The external pump and fluid reservoir are used to circulate fluid through an automotive cooling system. The heat transfer system is flushed of heat transfer fluid and filled with water. The thermostat is removed and a modified thermostat is installed to simulate an "open" thermostat condition. The procedure utilizes a reverse flow design through the heater core and ensures flow through the heater core. Gas generated in the system is purged through the system and discharged into the reservoir. The external pump draws cleaning solution from the reservoir, sends it into the heater core outlet, through the heater core, out of the heater core inlet hose, and into the heater outlet nipple on the engine. A discharge hose is connected from the heater inlet nipple on the engine back to the reservoir. An optional filter may be used on the discharge hose into the bucket to capture any cleaned debris. The vehicle engine is used to develop heat in the cleaning solution, but can only be run as long as the temperature of the cleaning solution remains below the boiling point. The system can be allowed to cool and the engine can optionally be restarted to reheat the solution but again the engine is only run as long as the temperature of the cleaning solution remains below the boiling point. The cleaning solution in the reservoir can be replaced between heating and cooling cycles. Additional cleaning solution can be added during a heating cycle to keep the temperature of the cleaning solution below the boiling point. The cooling step and reheating step can be repeated until the system is considered clean. The cleanliness of the system can be evaluated on the basis of the appearance of the cleaning solution. After circulating the cleaning solution the heat transfer system is flushed with water.

A conditioner can be used to passivate the heat transfer system after cleaning with the cleaning solution. The conditioner can comprise water, a water soluble pyrophosphate such as tetra-potassium pyrophosphate, in an amount of 0.5 to 80 weight percent, one or more azole compounds in an amount of 0.05 to 5 weight percent, alkaline metal phosphates, such as sodium phosphate or potassium phosphate, in an amount of 0 to 10 weight percent, alkaline metal polyphosphate, such as sodium tripolyphosphate, in an amount of 0 to 5 weight percent, and optional components, such as corrosion inhibitors, scale inhibitors, colorants, surfactants, antifoams, stop-leak agents (i.e., attaclay or soybean meals) etc. Amounts in this paragraph are based on the total weight of the conditioner.

The pH of the conditioning solution can be greater than or equal to 7.5 at room temperature (15 to 25° C.), or, more specifically, greater than or equal to 8.0, or, more specifically 8.5 to 11.

The conditioning solution is introduced to the heat transfer system in a method the same as or similar to that of the cleaning solution. Similar to the cleaning solution the conditioning solution should be circulated at a temperature less than the boiling temperature of the conditioning solution. The temperature of the conditioning solution can be between ambient and 80° C.

After the optional conditioner is removed and flushed from the heat transfer system the heat transfer fluid is added.

The heat transfer fluid can be a glycol based heat transfer fluid comprising an aliphatic carboxylic acid or salt thereof and/or an aromatic carboxylic acid. The heat transfer fluid can further comprise an azole, a phosphate, or a combination thereof. In addition, the heat transfer fluid also contain water, one or more glycol based freeze point depressants, and an optional pH adjusting agent to adjust the pH of the heat transfer fluid to between 7.5 to 9.0.

An exemplary heat transfer fluid for use as the refill heat transfer fluid in vehicle cooling systems comprises a freezing point-depressing in an amount of 10% to 99% by weight based on the total weight of the heat transfer fluid; deionized water; and a corrosion inhibitor package.

The freezing point depressant suitable for use includes alcohol or mixture of alcohols, such as monohydric or polyhydric alcohols and mixture thereof. The alcohol is selected from the group consisting of methanol, ethanol, propanol, butanol, furfurol, furfuryl alcohol, tetrahydrofurfuryl alcohol, ethoxylated furfuryl alcohol, ethylene glycol, diethylene glycol, triethylene glycol, 1,2-propylene glycol, 1,3-propylene glycol, dipropylene glycol, butylene glycol, glycerol, glycerol-1,2-dimethyl ether, glycerol-1,3-dimethyl ether, monoethylether of glycerol, sorbitol, 1,2,6-hexanetriol, trimethylopropane, alkoxy alkanols such as methoxyethanol and mixture thereof. The alcohol is present in the composition in an amount of about 10% to about 99.9% by weight based on the total weight of the heat transfer fluid. Within this range the alcohol can be present in an amount of 30% to 99.5% by weight, or, more specifically 40% to 99% by weight.

Water suitable for use includes deionized water or demineralized water. The water is present in the heat transfer fluid in an amount of about 0.1% to about 90% by weight, or, more specifically, 0.5% to 70%, or even more specifically 1% to 60% by weight based on the total weight of the heat transfer fluid.

The corrosion inhibitor package can comprise a mono or dibasic aliphatic ($C_6$ to $C_{15}$) carboxylic acids, the salt thereof, or the combination thereof. Exemplary mono or dibasic aliphatic carboxylic acids include 2-ethyl hexanoic acid, neodecanoic acid, and sebacic acid.

The corrosion inhibitor package can comprise an inorganic phosphate such as phosphoric acid, sodium or potassium orthophosphate, sodium or potassium pyrophosphate, and sodium or potassium polyphosphate or hexametaphosphate. The phosphate concentration in the heat transfer fluid can be 0.002% to 5% by weight, or, more specifically 0.01% to 1% by weight, based on the total weight of the heat transfer fluid.

The corrosion inhibitor package can comprise a water soluble magnesium compound, such as magnesium nitrate and magnesium sulfate. The magnesium ion concentration in the formulation can be 0.5 to 100 ppm Mg.

The corrosion inhibitor package can comprise at least one component selecting from the following (1) azole compounds or other copper alloy corrosion inhibitors; (2) phosphonocarboxylic acid mixture such as Bricorr 288; and (3) phosphinocarboxylic acid mixture, such as PSO.

Corrosion inhibitors for copper and copper alloys can also be included. The suitable copper and copper corrosion inhibitors include the compounds containing 5- or 6-member heterocyclic ring as the active functional group, wherein the heterocyclic ring contains at least one nitrogen atom, for example, an azole compound. Particularly, benzotriazole, tolyltriazole, methyl benzotriazole (e.g., 4-methyl benzotriazole and 5-methyl benzotriazole), butyl benzotriazole, and other alkyl benzotriazoles (e.g., the alkyl group contains from 2 to 20 carbon atoms), mercaptobenzothiazole, thiazole and other substituted thiazoles, imidazole, benzimidazole, and other substituted imidazoles, indazole and substituted indazoles, tetrazole and substituted tetrazoles, and mixtures thereof can be used as Cu and Cu alloy corrosion inhibitors. The copper and copper alloy corrosion inhibitors can be present in the composition in an amount of about 0.01 to 4% by weight, based on the total weight of the heat transfer fluid.

The heat transfer fluid can further comprise other heat transfer fluid additives, such as colorants, other corrosion inhibitors not listed above, dispersants, defoamers, scale inhibitors, surfactants, colorants, and antiscalants, wetting agents and biocides, etc.

Optional corrosion inhibitors include one or more water soluble polymers (MW: 200 to 200,000 Daltons), such as polycarboxylates, e.g., polyacrylic acids or polyacrylates, acrylate based polymers, copolymers, terpolymers, and quadpolymers, such as acrylate/acrylamide copolymers, polymethacrylates, polymaleic acids or maleic anhydride polymers, maleic acid based polymers, their copolymers and terpolymers, modified acrylamide based polymers, including polyacrylamides, acrylamide based copolymers and terpolymers; In general, water soluble polymers suitable for use include homo-polymers, copolymers, terpolymer and interpolymers having (1) at least one monomeric unit containing $C_3$ to $C_{16}$ monoethylenically unsaturated mono- or dicarboxylic acids or their salts; or (2) at least one monomeric unit containing $C_3$ to $C_{16}$ monoethylenically unsaturated mono- or dicarboxylic acid derivatives such as amides, nitriles, carboxylate esters, acid halides (e.g., chloride), and acid anhydrides, and combination thereof. Examples of monocarboxylic acids suitable for use in the instant invention for making the water soluble polymers include acrylic acid, methacrylic acid, ethacrylic acid, vinylacetic acid, allylacetic acid, and crotonic acid. Examples of monocarboxylic acid ester suitable for use include butyl acrylate, n-hexyl acrylate, t-butylaminoethyl methacrylate, diethylaminoethyl acrylate, hydroxyethyl methacrylate, hydrxypropyl acrylate, hydroxypropyl methacrylate, diethylaminoethyl methacrylate, dimethylaminoethyl methacrylate, dimethylaminoethyl acrylate, methyl acrylate, methyl methacrylate, tertiary butylacrylate, and vinyl acetate. Examples of dicarboxylic acids suitable for use include maleic acid, itaconic acid, fumaric acid, citaconic acid, mesaconic acid, and methylenemalonic acid. Examples of amides suitable for use include acrylamide (or 2-propenamide), methacrylamide, ethyl acrylamide, propyl acrylamide, tertiary butyl methacrylamide, tertiary octyl acrylamide, N,N-dimethylacrylamide (or N,N-dimethyl-2-propenamide), dimethylaminopropyl methacrylamide, cyclohexyl acrylamide, benzyl methacrylamide, vinyl acetamide, sulfomethylacrylamide, sulfoethylacrylamide, 2-hydroxy-3-sulfopropyl acrylamide, sulfophenylacrylamide, N-vinyl formamide, N-vinyl acetamide, 2-hydroxy-3-sulfopropyl acrylamide, N-vinyl pyrrolidone (a cyclic amide), carboxymethylacrylamide. Examples of anhydrides suitable for use include maleic anhydride (or 2,5-furandione) and succinic anhydride. Examples of nitriles suitable for use include acrylonitrile and methacrylonitrile. Examples of acid halides suitable for use include acrylamidopropyltrimethylammonium chloride, diallyldimethylammonium chloride, and methacrylamidopropyltrimethylammonium chloride. In addition, water soluble polymers containing at least one monomeric unit of the following monomer may also be used in the instant invention. The additional monomers suitable for use may be selected from the group consisting of allylhydroxypropylsulfonate, AMPS or 2-acrylamido-2-methylpropane sulfonic acid, polyethyleneglycol monomethacrylate, vinyl sulfonic acid, styrene sulfonic acid, acrylamidomethyl propane sulfonic acid, methallyl sulfonic acid, allyloxybenzenesulfonic acid, 1,2-dihydroxy-3-butene, allyl alcohol, allyl phosphonic acid, ethylene glycoldiacrylate, aspartic acid, hydroxamic acid, 2-ethyl-oxazoline, adipic acid, diethylenetriamine, ethylene oxide, propylene oxide, ammonia, ethylene diamine, dimethylamine, diallyl phthalate, 3-allyloxy-2hydroxy propane sulfonic acid, polyethylene glycol monomethacrylate, sodium styrene sulfonate, alkoxylated allyl alcohol sulfonate having the following structure:

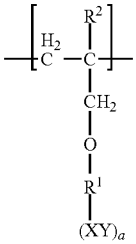

where $R^1$ is a hydroxyl substituted alkyl or alkylene radical having from 1 to about 10 carbon atoms, or a non-substituted alkyl or alkylene radical having from 1 to about 10 carbon atoms, or is $(CH_2—CH_2—O)_n$, $[CH_2—CH(CH_3)—O]_n$ or a mixture of both and "n" is an integer from about 1 to about 50; $R^2$ is H or lower alkyl ($C_1$-$C_3$) group; X, when present, is an anionic radical selected from the group consisting of $SO_3$, $PO_3$, $PO_4$, COO; Y, when present, is H or hydrogens or any water soluble cation or cations which together counterbalance the valance of the anionic radical; a is 0 or 1. The amount of the water soluble polymer in the heat transfer fluid will be in the range of about 0.005% to 10% by weight. The water soluble polymer may also be either polyether polyamino methylene phosphonate as described in U.S. Pat. No. 5,338,477 or phosphino polyacrylate acids.

Optional corrosion inhibitors can include one or more aliphatic tri-carboxylic acids (e.g., citric acid) or aliphatic tetra-carboxylic acids, such as 1, 2, 3, 4-alkane tetra-carboxylic acids, and preferably, 1, 2, 3, 4-butane tetra-carboxylic acid. The water soluble salts, esters or anhydrides of aliphatic tetra-carboxylic acids can also be used. The concentration range will be about 0.001% to 5% by weight of the heat transfer fluid.

Optional corrosion inhibitors can include at least one of a $C_4$-$C_{22}$ aliphatic or aromatic mono or di-carboxylic acid, molybdates, copper and copper alloy corrosion inhibitors, such as triazoles, thiazoles or other azole compounds; nitrates, nitrite, phosphonates, such as 2-phosphono-butane-1,2,4-tricarboxylic acid, amine salts, and borates.

Optional corrosion inhibitors can include at least one metal ion (e.g., in water soluble salt form) selecting from calcium, strontium, and/or zinc salts or combination thereof. The water soluble metal ion concentration should be in the range of 0.1 mg/l to about 100 mg/l in the heat transfer fluid.

It is contemplate that in some embodiments the heat transfer fluid is free of silicate.

Some non-ionic surfactants may also be included as corrosion inhibitors. The non-ionic surfactants suitable for use include fatty acid esters, such as sorbitan fatty acid esters, polyalkylene glycols, polyalkylene glycol esters, copolymers of ethylene oxide (EO) and propylene oxide (PO), polyoxyalkylene derivatives of a sorbitan fatty acid ester, and mixtures thereof. The average molecular weight of the non-ionic surfactants would be between about 55 to about 300,000, more preferably from about 110 to about 10,000. Suitable sorbitan fatty acid esters include sorbitan monolaurate (e.g., sold under tradename Span® 20, Arlacel® 20, S-MAZ® 20M1), sorbitan monopalmitate (e.g., Span® 40 or Arlacel® 40), sorbitan monostearate (e.g., Span® 60, Arlacel® 60, or S-MAZ® 60K), sorbitan monooleate (e.g., Span® 80 or Arlacel® 80), sorbitan monosesquioleate (e.g., Span® 83 or Arlacel® 83), sorbitan trioleate (e.g., Span® 85 or Arlacel® 85), sorbitan tridtearate (e.g., S-MAZ® 65K), sorbitan monotallate (e.g., S-MAZ® 90). Suitable polyalkylene glycols include polyethylene glycols, polypropylene glycols, and mixtures thereof. Examples of polyethylene glycols suitable for use include CARBOWAX™ polyethylene glycols and methoxypolyethylene glycols from Dow Chemical Company, (e.g., CARBOWAX PEG 200, 300, 400, 600, 900, 1000, 1450, 3350, 4000 & 8000, etc.) or PLURACOL® polyethylene glycols from BASF Corp. (e.g., Pluracol® E 200, 300, 400, 600, 1000, 2000, 3350, 4000, 6000 and 8000, etc.). Suitable polyalkylene glycol esters include mono- and di-esters of various fatty acids, such as MAPEG® polyethylene glycol esters from BASF (e.g., MAPEG® 200 mL or PEG 200 Monolaurate, MAPEG® 400 DO or PEG 400 Dioleate, MAPEG® 400 MO or PEG 400 Monooleate, and MAPEG® 600 DO or PEG 600 Dioleate, etc.). Suitable copolymers of ethylene oxide (EO) and propylene oxide (PO) include various Pluronic and Pluronic R block copolymer surfactants from BASF, DOWFAX non-ionic surfactants, UCON™ fluids and SYNALOX lubricants from DOW Chemical. Suitable polyoxyalkylene derivatives of a sorbitan fatty acid ester include polyoxyethylene 20 sorbitan monolaurate (e.g., products sold under trademarks TWEEN 20 or T-MAZ 20), polyoxyethylene 4 sorbitan monolaurate (e.g., TWEEN 21), polyoxyethylene 20 sorbitan monopalmitate (e.g., TWEEN 40), polyoxyethylene 20 sorbitant monostearate (e.g., TWEEN 60 or T-MAZ 60K), polyoxyethylene 20 sorbitan monooleate (e.g., TWEEN 80 or T-MAZ 80), polyoxyethylene 20 tristearate (e.g., TWEEN 65 or T-MAZ 65K), polyoxyethylene 5 sorbitan monooleate (e.g., TWEEN 81 or T-MAZ 81), polyoxyethylene 20 sorbitan trioleate (e.g., TWEEN 85 or T-MAZ 85K) and the like.

In addition, the corrosion inhibitor in the heat transfer fluid may also include one or more of the following compounds: amine salts of cyclohexenoic carboxylate compounds derived from tall oil fatty acids; amine compounds, such as mono-, di- and triethanolamine, morpholine, benzylamine, cyclohexylamine, dicyclohexylamine, hexylamine, AMP (or 2-amino-2-methyl-1-propanol or isobutanolamine), DEAE (or diethylethanolamine), DEHA (or diethylhydroxylamine), DMAE (or 2-dimethylaminoethanol), DMAP (or dimethylamino-2-propanol), and MOPA (or 3-methoxypropylamine).

A number of polydimethylsiloxane emulsion based antifoams can be used in the instant invention. They include PC-5450NF from Performance Chemicals, LLC in Boscawen, N.H.; CNC antifoam XD-55 NF and XD-56 from CNC International in Woonsocket in RI. Other antifoams suitable for use in the instant invention include copolymers of ethylene oxide (EO) and propylene oxide (PO), such as Pluronic L-61 from BASF.

Generally, the optional antifoam agents may comprise a silicone, for example, SAG 10 or similar products available from OSI Specialties, Dow Corning or other suppliers; an ethylene oxide-propylene oxide (EO-PO) block copolymer and a propylene oxide-ethylene oxide-propylene oxide (PO-EP-PO) block copolymer (e.g., Pluronic L61, Pluronic L81, or other Pluronic and Pluronic C products); poly(ethylene oxide) or poly(propylene oxide), e.g., PPG 2000 (i.e., polypropylene oxide with an average molecular weight of 2000); a hydrophobic amorphous silica; a polydiorganosiloxane based product (e.g., products containing polydimethylsiloxane (PDMS), and the like); a fatty acids or fatty acid ester (e.g., stearic acid, and the like); a fatty alcohol, an alkoxylated alcohol and a polyglycol; a polyether polylol acetate, a polyether ethoxylated sorbital hexaoleate, and a poly(ethylene oxide-propylene oxide) monoallyl ether acetate; a wax, a naphtha, kerosene and an aromatic oil; and combinations comprising one or more of the foregoing antifoam agents.

Exemplary heat transfer fluids are described in U.S. Patent Publication Nos. 2010-0116473 A1 and 2007-0075120-A1, which are incorporated by reference herein in their entirety.

The above-described methods and compositions are further illustrated by the following non-limiting examples.

EXAMPLES

In the Examples that follow the balance of the described compositions is deionized water.

Example 1

Engine block deposits taken from a heat transfer system having an aluminum CAB component were exposed to a commercially available heat transfer system cleaner. The cleaning solutions were tested by ICP before and after contact with the deposit. This example is a comparative example. Results are shown in Table 1.

TABLE 1

| ICP, mg/L | 20% Commercial Cooling System Cleaner (citrate based) - Test A 0.83 g of commercial cooling system cleaner (active: 5 wt % citric acid, pH = 9.2) + 3.17 g deionized water + 0.0030 g of aluminum engine deposit in a glass vial, 90 C. water bath, 50 min contact time. Deposit largely remained at end of the test. | |
|---|---|---|
| Al | <2 | 20 |
| B | 3.3 | 6 |
| Ca | 9.8 | 14 |
| Cu | <2 | <2 |
| Fe | <2 | <2 |
| K | 5.1 | <2 |
| Mg | 3 | 3.7 |
| Mo | <2 | <2 |
| Na | 3800 | 4000 |
| P | 30 | 30 |
| Pb | <2 | <2 |
| Si | <2 | 7.1 |
| Sr | <2 | <2 |
| Zn | <2 | <2 |
| pH | >8 | |

Example 1 shows that a commercial cleaner having citric acid is insufficient to address the problem. Notably the pH of the cleaning solution was greater than 8.

Example 2

Aluminum heat exchanger tubes (type #1) blocked with corrosion products from an automotive heat transfer system having CAB aluminum components (which were not cleaned prior to installation) were exposed to various cleaning solutions for evaluation as described in Table 2. The cleaning solution was analyzed by inductively coupled plasma mass spectrometry (ICP) before and after exposure to the blocked tubes. Some tubes were cut open on one side prior to testing so that the cleaning fluid was applied by a pipette streaming solution over the opened tube interior surface. Some tubes were not cut open. The unopened tubes were cleaned by slowly adding the cleaning solution to one end of the tube (i.e., the entrance end). The cleaning solution flowed out of the tube from the other end (i.e., the exit end). The appearance of the "opened" tube was visually evaluated before and after cleaning Closed tubes were opened for inspection after cleaning. The cleaning solution was heated to about 90° C. and applied to the tube while hot as described in Table 2.

TABLE 2

| | A | | B | | C | | D | | E | |
|---|---|---|---|---|---|---|---|---|---|---|
| | Cleaning Conditions | | | | | | | | | |
| | 50 g of 2% Chemfac PF-636 used. 76-77 C., cleaner contact time = 25 min via a pipet | | 50.0011 g of 2% Oxalic acid dihydrate + 0.1 wt % benzotriazole solution used as cleaner. pH_initial = 1.48. 77-78 C., cleaner added via a pipet for 21 min | | 50.0121 g of 4% Oxalic acid dihydrate + 0.3 wt % benzotriazole solution used as cleaner. T up to 90 C., Average T = 76-77 C., cleaner added via a pipet for 18 min. | | 50.0084 g of 2% Oxalic acid dihydrate + 0.15 wt % benzotriazole + 2 wt % Chemfac PF-636 solution used as cleaner. T up to 90 C., cleaner added via a pipet for 18 min | | 50 g of 2 wt % Oxalic acid dihydrate + 0.15 wt % benzotriazole (from 20% benzotriazole in ethylene glycol) + 0.0125% Pluronic L-61 + 0.0125% Liquitint Patent Blue, 75 +– 2 C., cleaner added via a pipet for 30 min. | |
| ICP | Before mg/L | After mg/L | Before mg/L | After mg/L | Before mg/L | After mg/L | Before mg/L | After mg/L | Before mg/L | After mg/L |
| Al | 2.4 | 500 | <2 | 1100 | <2 | 1200 | <2 | 1500 | <2 | 770 |
| B | <2 | 65 | <2 | 68 | <2 | 84 | <2 | 62 | <2 | 69 |
| Ca | 11 | 13 | <2 | 6.3 | 2.3 | 9.2 | 2.9 | 14 | 2.7 | 5.6 |
| Cu | <2 | 7.9 | <2 | <2 | <2 | <2 | <2 | <2 | <2 | <2 |
| Fe | <2 | 4 | <2 | 5.6 | <2 | 5.6 | <2 | 9.3 | <2 | 2.9 |
| K | 2.6 | 160 | <2 | 160 | <2 | 170 | <2 | 140 | <2 | 42 |
| Mg | 2.7 | 4.7 | <2 | 5.2 | <2 | 5.7 | <2 | 5.7 | <2 | 3.8 |
| Mo | <2 | <2 | <2 | <2 | <2 | <2 | <2 | <2 | <2 | <2 |
| Na | 11 | 180 | 4.1 | 180 | 4.7 | 230 | 7.1 | 160 | 4 | 180 |
| P | 2500 | 2500 | <2 | 5.4 | <2 | 6.7 | 2600 | 3400 | <2 | 5.6 |
| Pb | <2 | <2 | <2 | <2 | <2 | <2 | <2 | <2 | <2 | <2 |
| Si | <2 | 51 | <2 | 64 | <2 | 77 | <2 | 64 | <2 | 56 |
| Sr | <2 | <2 | <2 | <2 | <2 | <2 | <2 | <2 | <2 | <2 |
| Zn | <2 | 19 | <2 | 22 | <2 | 26 | <2 | 28 | <2 | 19 |
| Deposit on Tube Surface and cleaning results | 100% of the tube surface covered with deposits | A continuous layer of deposit remained. The deposit layer is partially removed. | 100% of the tube surface covered with deposits | Tube surface became fully cleaned at 18 min. Cleaning stopped at 21 min. | 100% of the tube surface covered with deposits | Tube surface became fully clean after 15 min. Cleaning stopped at 18 min. | 95% of the tube surface covered with deposits | Tube surface became fully clean after 15 min. Cleaning stopped at 18 min. | 100% of the tube surface covered with deposits | All deposits were removed. Dye appears to be stable |

TABLE 2-continued

| | F | | G | | H* | | I | | J* | |
|---|---|---|---|---|---|---|---|---|---|---|
| | Cleaning Conditions | | | | | | | | | |
| | 50 g of 2 wt % Oxalic acid dihydrate + 0.15 wt % benzotriazole (from 20% benzotriazole in ethylene glycol) + 0.031 wt % sodium tripolyphosphate + 0.25% Pluronic L-61 + 0.0125% Liquitint Patent Blue, 75 +– 2 C., cleaner added via a pipet for 30 min. | | 50 g of 2 wt % Oxalic acid dihydrate + 0.5 wt % Chemfac PF-636 + 0.15 wt % benzotriazole (from 20% benzotriazole in ethylene glycol) + 0.031 wt % sodium tripolyphosphate + 0.005% Pluronic L-61 + 0.0125% Liquitint Patent Blue, 75 +– 2 C., cleaner added via a pipet for 30 min. | | 2.0% Oxalic Acid dihydrate + 0.1 wt % benzotriazole | | 50.0 g of 2.1 wt % Oxalic acid dihydrate solution used as cleaner. pH_initial = 1.5. 78 +– 2 C., cleaner added via a pipet for 25 min | | 50 g cleaning solution containing 2.1 wt % Oxalic Acid dihydrate (balance is DI water), pH = 1.5. Solution added by a pipet to a syringe with needle inserted into one end of the heater core tube. Cleaning solution temperature = 65 +– 2 C. Cleaning time was 30 minutes. | |
| ICP | Before mg/L | After mg/L | Before mg/L | After mg/L | Before mg/L | After mg/L | Before mg/L | After mg/L | Before mg/L | After mg/L |
| Al | <2 | 730 | 10 | 800 | 3.6 | 800 | NA | 870 | NA | 390 |
| B | <2 | 46 | <2 | 66 | <2 | 54 | NA | 62 | NA | 38 |
| Ca | 3.2 | 7.5 | 13 | 7.7 | 8.6 | 6.7 | NA | 4 | NA | 4.6 |
| Cu | <2 | <2 | 5 | <2 | 28 | <2 | NA | <2 | NA | <2 |
| Fe | <2 | 3.4 | 3.1 | 4 | 5.1 | 8.4 | NA | 5.4 | NA | 8.4 |
| K | <2 | 52 | <2 | 72 | <2 | 44 | NA | 79 | NA | 17 |
| Mg | <2 | 3.6 | 2.8 | 4.4 | 2.9 | 4.8 | NA | 4.5 | NA | 3 |
| Mo | <2 | <2 | <2 | <2 | <2 | <2 | NA | <2 | NA | <2 |
| Na | 110 | 200 | 100 | 270 | <2 | 140 | NA | 160 | NA | 100 |
| P | 78 | 73 | 680 | 690 | <2 | 4.1 | NA | 5.1 | NA | 3.2 |
| Pb | <2 | <2 | <2 | <2 | 2.6 | <2 | NA | <2 | NA | <2 |
| Si | <2 | 46 | <2 | 61 | 2.2 | 51 | NA | 55 | NA | 31 |
| Sr | <2 | <2 | <2 | <2 | <2 | <2 | NA | <2 | NA | <2 |
| Zn | <2 | 16 | 2 | 19 | 9 | 19 | NA | 20 | NA | 11 |
| Deposit on Tube Surface and cleaning results | 95% of the tube surface covered with deposits | All deposits were removed. Dye appears to be stable | 100% of the tube surface covered with deposits | All deposits were removed. Dye appears to be stable | >50% of the tube surface covered with deposits | All deposits were removed. Dye appears to be stable | NA | Tube surface became fully cleaned after 25 min. | NA | About 80% of the deposits were removed from the surface at the end of the test based on post test inspection of the opened tube. |

*Partially blocked closed tube

NA —not available

Example 2A demonstrates that an organophosphate cleaning solution is unable to remove the deposits from the tube surface. The remaining examples show that use of cleaning solution comprising an organic acid having a pKa less than 5 removed the deposit.

Example 3

Aluminum heat exchanger tubes (type#2) blocked with corrosion from an automotive heat transfer system having CAB aluminum components (which were not cleaned prior to installation) were exposed to various cleaning solutions for evaluation as described in Table 3. The cleaning solution was analyzed by inductively coupled plasma mass spectrometry (ICP) before and after exposure to the blocked tubes. The appearance of the tube was visually evaluated before and after cleaning. The cleaning solution was heated to 90° C. and applied to the tube while hot. The temperature listed in the table for each test is lower than 90° C. due to the cooling effect of the heat exchanger tube after the cleaning solution of was in the contact with the tube surface.

TABLE 3

| | Open tube Section A 2.0% Oxalic Acid dihydrate + 0.1 wt % benzotriazole, 50 g solution used, 30 min, 82 +− 2° C. >90% deposit removed | | Open tube Section B 2.0% Oxalic Acid dihydrate + 0.1 wt % benzotriazole + 0.2 wt % AR-900, 50 g solution used, 45 min, 82 +− 2° C. >95% deposit removed | | Closed whole tube C 260 g of 2.0 wt % Oxalic acid dihydrate + 0.15 wt % benzotriazole + 0.2 wt % AR-900 solution. 74 +− 2 C., 50 min cleaning, gravity feed via a 60 ml syringe. 90% deposit removed | |
|---|---|---|---|---|---|---|
| ICP | Before mg/L | After mg/L | Before mg/L | After mg/L | Before mg/L | After mg/L |
| Al | <2 | 970 | <2 | 1400 | <2 | 960 |
| B | <2 | 49 | <2 | 78 | <2 | 61 |
| Ca | <2 | 13 | <2 | 21 | 2.7 | 16 |
| Cu | <2 | <2 | <2 | <2 | <2 | <2 |
| Fe | <2 | 6 | <2 | 7.2 | <2 | 5 |
| K | <2 | 73 | <2 | 150 | <2 | 17 |
| Mg | <2 | 7.5 | <2 | 12 | <2 | 5.6 |
| Mo | <2 | <2 | <2 | <2 | <2 | <2 |
| Na | <2 | 160 | 120 | 290 | 130 | 250 |
| P | <2 | 7.1 | <2 | 9.9 | <2 | 8 |
| Pb | <2 | <2 | <2 | <2 | <2 | <2 |
| Si | <2 | 63 | <2 | 90 | <2 | 70 |
| Sr | <2 | <2 | <2 | <2 | <2 | <2 |
| Zn | <2 | 9.8 | <2 | 12 | <2 | 12 |

Example 4

Deposits from a radiator used in a vehicle wherein the heat transfer system comprised an aluminum component made by CAB (that was not cleaned prior to installation) were exposed to various cleaning solutions. The cleaning solutions were tested by ICP prior to the exposure and after the exposure. The measured temperatures of the cleaning solutions are shown in Table 4 for the samples where temperature was measured. Results are in Table 5.

TABLE 4

| A | | B | | C | | D | | F | | G | | I | | J | | K | |
|---|---|---|---|---|---|---|---|---|---|---|---|---|---|---|---|---|---|
| E-time | ° C. | E-time | ° C. | E-time | ° C. | E-time | ° C. | E-time | ° C. | E-time | ° C. | E-time | ° C. | E-time | ° C. | E-time | ° C. |
| 7 | 88.40 | 9 | 83.3 | 11 | 84 | 12 | 85.6 | 10 | 84.2 | 0 | 85.3 | 0 | 85.6 | 0 | 87.1 | 0 | 86 |
| 22 | 85.80 | 24 | 87.8 | 25 | 86 | 19 | 87.4 | 16:50 | 86.6 | 10 | 88.9 | 6 | 88.4 | 32 | 89.8 | 20 | 89.4 |
| 34 | 86.50 | 35 | 88.6 | 35 | 88 | 36 | 87.5 | 30 | 89.2 | 20 | 92.3 | 50 | 90 | 42 | 93 | 46 | 89.7 |
| 43 | 92.30 | 50 | 88.5 | 42 | 88 | 50 | 91 | 57:45 | 88.6 | 30 | 90 | 60 | 93.6 | 60 | 92.7 | 55 | 93.5 |
| 50 | 90.20 | | | 50 | 89 | | | 60 | 87.4 | 45 | 90.2 | | | | | 60 | 92.6 |
| | | | | | | | | | | 60 | 93.9 | | | | | | |

*E-time: elapsed time in minutes

TABLE 5

| | A | | B | | C | |
|---|---|---|---|---|---|---|
| ICP, mg/L | Before 4.0036 g of test solution, i.e., 4.46 g chemfac PF-636 in 95.57 g of DI $H_2O$, used. Water bath T = 90 C., 50 min contact time, 0.0612 g deposit added to vial. A slight amount of residue remained at the end of test | After | Before 4.0038 g of test solution, i.e., 2.23 g chemfac PF-636 in 97.78 g of DI $H_2O$, used. Water bath T = 90 C., 50 min contact time, 0.0603 g deposit added to vial. A slight amount of residue remain after test. | After | Before 4.0052 g of test solution, i.e., of 20.01 g of 10% oxalic acid dihydrate solution + 0.1006 g benzotriazole in 79.92 g of DI H2O, used. Water bath T = 90 C., 50 min contact time, 0.0609 g deposit added to vial. Some deposit dissolve, a modest amount remained after test | After |
| Al | <2 | 800 | <2 | 590 | 2.7 | 800 |
| B | <2 | 65 | <2 | 55 | <2 | 61 |
| Ca | <2 | 11 | <2 | 4 | 3.9 | 7.6 |
| Cu | <2 | 2.3 | <2 | <2 | 6.4 | 9.4 |
| Fe | <2 | 9 | <2 | 6.3 | <2 | 11 |
| K | <2 | 6.7 | <2 | 4.1 | <2 | 5.3 |
| Mg | <2 | 6 | <2 | 3.5 | <2 | 5.7 |
| Mo | <2 | <2 | <2 | <2 | <2 | <2 |

TABLE 5-continued

| | | | | | | |
|---|---|---|---|---|---|---|
| Na | 3.1 | 170 | <2 | 140 | 3.7 | 140 |
| P | 5300 | 5700 | 2800 | 2600 | <2 | 5.9 |
| Pb | <2 | <2 | <2 | <2 | <2 | <2 |
| Si | <2 | 73 | <2 | 58 | <2 | 71 |
| Sr | <2 | <2 | <2 | <2 | <2 | <2 |
| Zn | <2 | 28 | <2 | 21 | <2 | 29 |
| pH | 1.58 | | 1.78 | | 1 | |

| | D | | E* | | F* | |
|---|---|---|---|---|---|---|
| | Before | After | Before | After | Before | After |
| ICP, mg/L | 4.0028 g of test solution, i.e., 2.0055 g of maleic acid in 98.01 g of DI H2O, was used. Water bath T = 90 C., 50 min contact time, 0.0611 g deposit added to vial. A moderate to heavy residue remained. | | 4 g of (2 g Maxhib PT-10T + 98 g DI H2O) used as test solution, water bath = 90 C., 50 min 0.0597 g of deposit added to vial, 60% deposit remained. | | 4.0052 g of (2.02 g Maxhib AA-0223 + 97.99 g DI H2O) used as test solution, water bath = 90 C., 60 min. 0.0598 g of deposit added to vial, Heavy amount of deposit remained. | |
| Al | <2 | 530 | <2 | 68 | <2 | 200 |
| B | <2 | 50 | <2 | 46 | <2 | 56 |
| Ca | 3.2 | 5.1 | 4.1 | 3.5 | <2 | 6.7 |
| Cu | <2 | 2.2 | <2 | <2 | <2 | <2 |
| Fe | <2 | 5.7 | <2 | <2 | <2 | <2 |
| K | <2 | 4.4 | <2 | <2 | 10 | 14 |
| Mg | <2 | 3.6 | <2 | <2 | <2 | 3.7 |
| Mo | <2 | <2 | <2 | <2 | <2 | <2 |
| Na | 3 | 120 | 5.7 | 110 | 2.4 | 140 |
| P | <2 | 11 | 430 | 380 | 970 | 770 |
| Pb | <2 | <2 | <2 | <2 | <2 | <2 |
| Si | <2 | 55 | <2 | 22 | <2 | 52 |
| Sr | <2 | <2 | <2 | <2 | <2 | <2 |
| Zn | <2 | 21 | <2 | 3.9 | <2 | 18 |
| pH | 1.62 | | 8.36 | | 2.22 | |

| | G | | H | | I | |
|---|---|---|---|---|---|---|
| | Before | After | Before | After | Before | After |
| ICP, mg/L | 4.0 g of test solution, i.e., 2 wt % Oxalic acid dihydrate + 0.15 wt % BZT (from 20% BZT in EG) + 0.0125 wt % Pluronic L-61 + 0.0125 wt % D11013X Chromatint Yellow 0963. Water bath T = 90 C., 60 min contact time, 0.0561 g deposit added to vial. Some deposit dissolved, a lot of deposit remained after test | | 4.0 g of a test solution containing 2.0 wt % citric acid, 0.1 wt % benzotriazole and 97.9 wt % DI water (pH = 2.16) added to the vial containing 0.0671 g deposit, room Temperature, 2 days contact time. Lots of Deposit largely remained @ end of the test. Top portion solution sent for analysis | | 4.0 g of test solution, i.e., 2 wt % Oxalic acid dihydrate + 0.15 wt % BZT (from 20% BZT in EG) + 0.0125 wt % Pluronic L-61 + 0.0125 wt % D11013X Chromatint Yellow 0963 (i.e., 150 g 2428-31 + 450 g DI H2O) was used.. Water bath T = 90 C., 60 min contact time, 0.0562 g deposit added to vial. Some deposit dissolved, a lot of deposit remained after test. Top portion of solution submitted for analysis | |
| Al | <2 | 520 | <2 | 160 | <2 | 660 |
| B | <2 | 48 | <2 | 54 | <2 | 56 |
| Ca | 4.6 | <2 | <2 | 3.2 | <2 | 4.5 |
| Cu | <2 | <2 | <2 | <2 | <2 | <2 |
| Fe | <2 | 5.6 | <2 | <2 | <2 | 7.5 |
| K | <2 | 3.5 | <2 | 4.5 | <2 | 3.2 |
| Mg | <2 | 3.2 | <2 | <2 | <2 | 3.8 |
| Mo | <2 | <2 | <2 | <2 | <2 | <2 |
| Na | 3700 | 3700 | <2 | 150 | <2 | 140 |
| P | <2 | 4.2 | <2 | 2.5 | <2 | 4.7 |
| Pb | <2 | <2 | <2 | <2 | <2 | <2 |
| Si | <2 | 52 | <2 | 43 | <2 | 63 |
| Sr | <2 | <2 | <2 | <2 | <2 | <2 |
| Zn | <2 | 19 | <2 | 15 | <2 | 24 |
| pH | 2.5 | | 2.16 | | 1 | |

TABLE 5-continued

| ICP, mg/L | K Before | K After | J Before | J After |
|---|---|---|---|---|
| | 4.0 g of test solution, i.e., 2 wt % Oxalic acid dihydrate + 0.15 wt % BZT (from 20% BZT in EG) + 0.0125 wt % Pluronic L-61 + 0.0125 wt % D11013X Chromatint Yellow 0963). Water bath T = 90 C., 60 min contact time, 0.0578 g deposit added to vial. Some deposit dissolve, a lot of deposit remained after test. Top portion of solution submitted for analysis | | 4.0 g of a test solution containing 2.0 wt % citric acid and 98 wt % DI water added to the vial containing 0.0556 g deposit, 90 C., 60 min contact time. Lots of Deposit largely remained at end of the test. Top portion solution sent for analysis. | |
| Al | <2 | 550 | <2 | 410 |
| B | <2 | 50 | 2.1 | 64 |
| Ca | <2 | 2 | <2 | 4.2 |
| Cu | <2 | <2 | <2 | <2 |
| Fe | <2 | 5.7 | <2 | 4.1 |
| K | <2 | 5.2 | <2 | 4.4 |
| Mg | <2 | 3.2 | <2 | 3.5 |
| Mo | <2 | <2 | <2 | <2 |
| Na | 4400 | 4800 | <2 | 140 |
| P | <2 | 4.4 | <2 | 3.9 |
| Pb | <2 | <2 | <2 | <2 |
| Si | <2 | 63 | <2 | 65 |
| Sr | <2 | <2 | <2 | <2 |
| Zn | <2 | 20 | <2 | 25 |
| pH | 3.5 | | 2.18 | |

*Comparative Examples

Example 5

Deposits taken from a heat transfer system having an aluminum CAB component were exposed to a variety of cleaning solutions as described herein. The cleaning solutions were tested by ICP before and after contact with the deposit. Results are shown in Table 6.

TABLE 6

| ICP, mg/L | A Before | A After | B Before | B After |
|---|---|---|---|---|
| | 2.1 wt % Oxalic acid dihydrate 0.84 g of the cleaning solution 2420-121 (10 wt % oxalic acid dihydrate, pH = 0.9) + 3.16 g DI water added into a glass vial with 0.0116 g of aluminum heater core deposit, 90 C. water bath, 50 min contact time. 95% of the deposit dissolved at end of the test. | | 2.1 wt % Oxalic acid dihydrate 0.84 g of the cleaning solution 2420-121 (10 wt % oxalic acid dihydrate, pH = 0.9) + 3.16 g DI water + 0.0116 g of aluminum heater core deposit in the vial containing the insoluble aluminum heater core deposit from Test C, 90 C. water bath, 50 min contact time. ~80% of the deposit dissolved at end of the test. | |
| Al | <2 | 450 | <2 | 380 |
| B | <2 | 18 | <2 | <2 |
| Ca | 3.7 | 4.9 | 3.7 | 6.8 |
| Cu | <2 | <2 | <2 | <2 |
| Fe | <2 | 4.3 | <2 | 4.9 |
| K | 5.8 | 3.4 | 5.8 | 4.9 |
| Mg | <2 | 3 | <2 | 2.4 |
| Mo | <2 | <2 | <2 | <2 |
| Na | 9.7 | 44 | 9.7 | 25 |
| P | <2 | <2 | <2 | 2.6 |
| Pb | <2 | <2 | <2 | <2 |
| Si | <2 | 24 | <2 | 11 |
| Sr | <2 | <2 | <2 | <2 |
| Zn | <2 | 8 | <2 | 4.2 |
| pH | 0.98 | | 0.98 | |

Example 6

A Corr Instruments NanoCorr Coupled Multi-electrode Sensor (CMS) Analyzer with Corr Visual Software, Version 2.2.3 was used to determine the localized corrosion rate of cast aluminum in the test solution. In this study, a 25-electrode sensor array probe supplied by Corr Instruments was used. Each electrode of the probe was made of an aluminum alloy square wire having an exposed surface area of 1 $mm^2$. The 25 wire electrodes sealed in epoxy and spaced uniformly in a 1.2×1.2 cm matrix array were connected electrically. The coupled multi-electrode probe simulates the corrosion conditions of a conventional one-piece electrode surface having an exposed surface area of about 1.4 $cm^2$. A localized corrosion rate was obtained as a function of time from the probe by measuring the coupling current from each individual electrode in the probe and performing statistical analysis of the measured data. In this study, a sampling rate of 30 seconds per set of data was used.

A Pyrex glass beaker holding 500 milliliter test solution was used as the test cell. The coupled multi-electrode array sensor probe, a Ag/AgCl (3M KCl) reference electrode placed in a Lugin probe with the opening close to the multi-electrode sensor probe, and two temperature sensor probes (i.e., a thermal couple and a resistance temperature detector with stainless steel sheath) were mounted on a Teflon cell cover and immersed in the solution in the beaker. The Teflon cover was used to minimize solution loss during the experiment and also used to fix the position of the test probes in the cell. A microprocessor control hot-plate was used to heat the solution to the desired temperature during the test. A Teflon coated magnetic stirring bar was also used to agitate the solution during the test. The solution was exposed to the air during the test. The corrosion rate of the aluminum alloy was evaluated in different solutions. Experimental details and results are shown in FIGS. 1 and 2.

All ranges disclosed herein are inclusive and combinable. While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A treatment system for a heat transfer system comprising: a cleaner comprising an azole compound and an organic acid having a pKa of less than or equal to 5.0 at 25° C.; and a conditioner separate from the cleaner wherein the conditioner comprises a pyrophosphate, an azole, and an alkaline metal phosphate.

2. The treatment system of claim 1, wherein the organic acid comprises oxalic acid.

3. The treatment system of claim 1, further comprising an organic phosphate ester.

4. The treatment system of claim 1, wherein the cleaner is combined with water to form a cleaning solution.

5. The treatment system of claim 1 further comprising a refill heat transfer fluid.

6. The treatment system of claim 1 wherein the cleaner is a solid.

7. The treatment system of claim 4, wherein the cleaning solution has a pH less than or equal to 2.0.

8. The treatment system of claim 5, wherein the refill heat transfer fluid is free of silicate.

9. A treatment system for a heat transfer system comprising:

a cleaner comprising an azole compound and an organic acid having a pKa of less than or equal to 5.0 at 25° C.;

a conditioner separate from the cleaner comprising a pyrophosphate, an azole, and an alkaline metal phosphate;

wherein the cleaner, when diluted with water, has a pH less than or equal to 2.0 at room temperature and the conditioner, when diluted with water, has a pH greater than or equal to 7.5 at room temperature.

10. A method of cleaning a heat transfer system comprising:

draining a heat transfer fluid from the heat transfer system;

filling the heat transfer system with a cleaning solution wherein the cleaning solution comprises an azole compound and an organic acid having a pKa of less than or equal to 5.0 at 25° C.;

circulating the cleaning solution through the heat transfer system;

draining the cleaning solution from the heat transfer system;

filling the heat transfer system with a conditioning solution comprising a pyrophosphate, an azole, and an alkaline metal phosphate; and circulating the conditioning solution through the heat transfer system, wherein the heat transfer system comprises a controlled atmosphere brazed component.

11. The method of claim 10, wherein the cleaning solution has a pH less than or equal to 2.0.

12. The method of claim 10, wherein the conditioning solution has a pH greater than or equal to 7.5 at room temperature.

13. The method of claim 10, further comprising draining the conditioning solution and filling the heat transfer system with a heat transfer fluid free of silicate.

* * * * *